US005394129A

United States Patent [19]

Obasih et al.

[11] Patent Number: 5,394,129

[45] Date of Patent: Feb. 28, 1995

[54] SUPERCONDUCTING SWITCH THERMAL INTERFACE FOR A CRYOGENLESS SUPERCONDUCTING MAGNET

[75] Inventors: Kemakolam M. Obasih, Florence; James R. Briske, Hartsville, both of S.C.

[73] Assignee: General Electric Company, Milwaukee, Wis.

[21] Appl. No.: 940,114

[22] Filed: Sep. 3, 1992

[51] Int. Cl.[6] ..... H01F 1/00

[52] U.S. Cl. ..... 335/216; 335/299; 174/15.4; 62/51.1

[58] Field of Search ..... 335/216, 299; 174/15.4; 62/51.1, 514 R

[56] References Cited

U.S. PATENT DOCUMENTS

| | | | |
|---|---|---|---|
| 4,016,526 | 4/1977 | Gamet et al. | 335/216 |
| 4,695,675 | 9/1987 | Yamamoto | 335/216 |
| 4,803,456 | 2/1989 | Benesch . | |
| 4,876,413 | 10/1989 | Vermilyea | 174/15.4 |
| 4,924,198 | 5/1990 | Laskaris . | |
| 4,943,792 | 7/1990 | Srivastava et al. . | |
| 5,032,869 | 7/1991 | Herd et al. . | |
| 5,034,713 | 7/1991 | Herd et al. . | |
| 5,093,645 | 3/1992 | Dorri et al. | 335/216 |

OTHER PUBLICATIONS

Applicant's Exhibit No. 1, pp. 91–130 (Chapter 6) and 256–278 (Chapter 11) of "Superconducting Magnets" by Martin N. Wilson, 1983.

*Primary Examiner*—Lincoln Donovan
*Attorney, Agent, or Firm*—Quarles & Brady

[57] ABSTRACT

A thermal interface for a superconducting switch of a cryogenless superconducting magnet is thermally insulated from and supported by the main magnet support structure and is connected to the cold stage of a cryocooler by a thermal bus bar having a coefficient of thermal conductivity which decreases as the temperature of the switch increases.

8 Claims, 3 Drawing Sheets

SUPERCONDUCTING SWITCH THERMAL INTERFACE FOR A CRYOGENLESS SUPERCONDUCTING MAGNET

FIELD OF THE INVENTION

This invention relates to a thermal interface for a superconducting switch of a cryogenless superconducting magnet, and in particular to such a structure for supporting the switch from the magneto's coil support structure in thermal isolation during ramping and for cooling the switch by conduction to the superconducting state after ramping

BACKGROUND OF THE INVENTION

Superconducting magnets are capable of operating in a persistent state, where no power is dissipated due to zero electrical resistance to the electrical current flowing through the magnet coils. In order to ramp the current flowing through the magnet coils up to the desired amperage so as to produce a magnetic field of the desired strength, the coils are connected to a power supply through power leads which dissipate energy and prevent the persistent mode of magnet operation. After ramping, the magnet terminals are shorted out with a superconducting switch to complete the circuit for the current flowing through the magnet coils to achieve the persistent state.

This method of ramping up superconducting magnets is well known as are superconducting switches for providing the superconducting link between the magnet terminals for persistent state operation after the magnet has been ramped up. Such a superconducting switch consists of superconductors which are warmed to their normal (non-superconducting) state during ramp-up operation and are then cooled to the superconducting state for persistent mode operation. Energy is dissipated in the switch from quench heaters used to drive the switch normal prior to ramp-up and then from a voltage imposed by the power supply across the switch while in the normal state during ramp-up. Depending on the type of switch conductors, the dissipated energy can be quite substantial, which results in local relatively high temperatures.

In cryogenless conduction cooled magnets, the heat dissipated by the switch presents a particular problem. The heat from the switch diffuses to the main coil support structure because it is a large cold mass. In cryogenless type magnets, the large cooling capacity of liquid helium is not available. Refrigeration is provided by a cryocooler with limited cooling power. Therefore, so that the cryocooler is not overburdened in cooling the switch in proportion to the remainder of the magnet, it is desirable to thermally isolate the switch from the main coil support structure.

However, when the magnet attains its operating current during ramping, the switch needs to be cooled down to its superconducting state in order for the magnet to be persistent. In cryogenless type magnets, it is most desirable to cool the switch using the cold stage of the cryocooler, which is at odds with efficiently using the cooling capacity of the cryocooler for the main coils, so as to prevent the main coils from going from the superconductive state to the normal state, also known as a quench.

SUMMARY OF THE INVENTION

The invention provides a thermal interface for a superconducting switch which overcomes the above disadvantages. In an interface of the invention, a superconducting magnet has a superconducting magnet coil for producing a magnetic field along a magnet axis and a structure supporting the coil to be substantially coaxial with the magnet axis. A refrigerated cold sink cools the magnet coil below a transition temperature at which the coil becomes superconducting and a superconducting switch is provided for completing a closed superconducting electrical circuit including the coil. The superconducting switch is supported on the structure by means which thermally insulate the switch from the structure and a thermal bus bar connects the switch and the cold sink providing thermally conductive communication directly between the cold sink and the switch.

This interface allows the dissipated heat during a quench or ramp-up operation to be contained within the switch and thermally isolated from the magnet coil support structure. It also allows only a certain controlled rate for the heat from the switch to be dissipated to the cold stage of the cryocooler. This prevents overloading the cryocooler, which could otherwise result in the cold stage temperature of the cryocooler rising past the temperature necessary to maintain the temperature of the magnet coils below the superconducting to normal state transition temperature during ramping. This interface also provides for cooling the switch back to the superconducting state after ramp-up, so that the magnet may enter the persistent state.

In a preferred form, the bus bar has a thermal conductivity which decreases as the temperature of the bus bar increases. Thereby, the rate of heat transfer from the switch to the cold stage stays constant or may even decrease as the temperature of the switch rises, so as to protect the cold stage from thermal overload.

In another aspect, the bus bar is sized so as to provide a certain cooling rate during ramping of the coil and recovery of the switch to a persistent state. By selecting the size of the bus bar, the rate that heat is dissipated to the cold stage during ramping can be controlled as can the recovery time of the switch to the superconducting state after ramping. The cryocooler can therefore be designed to have a lower maximum capacity since it can dissipate the heat from the switch over a longer controlled period of time than would be the case if the heat from the switch were dissipated to the main coil support structure.

It is therefore an important object of the invention to provide a thermal interface for a superconducting switch which provides for controlled cooling of the switch and thermally isolates the switch from the main magnet coils.

It is another object of the invention to provide such a thermal interface which in a simple construction having no moving parts.

It is another object of the invention to provide a thermal interface for a superconducting switch which prevents overloading a cryocooler which cools the switch.

It is another object of the invention to provide a thermal interface for a superconducting switch which conserves energy.

It is another object of the invention to provide a thermal interface for a superconducting switch which allows using a smaller capacity cryocooler than would otherwise be needed.

These and other objects and advantages of the invention will be apparent from the following description and from the drawings.

DETAILED DESCRIPTION OF THE PREFERRED EMBODIMENTS

Figure 1:
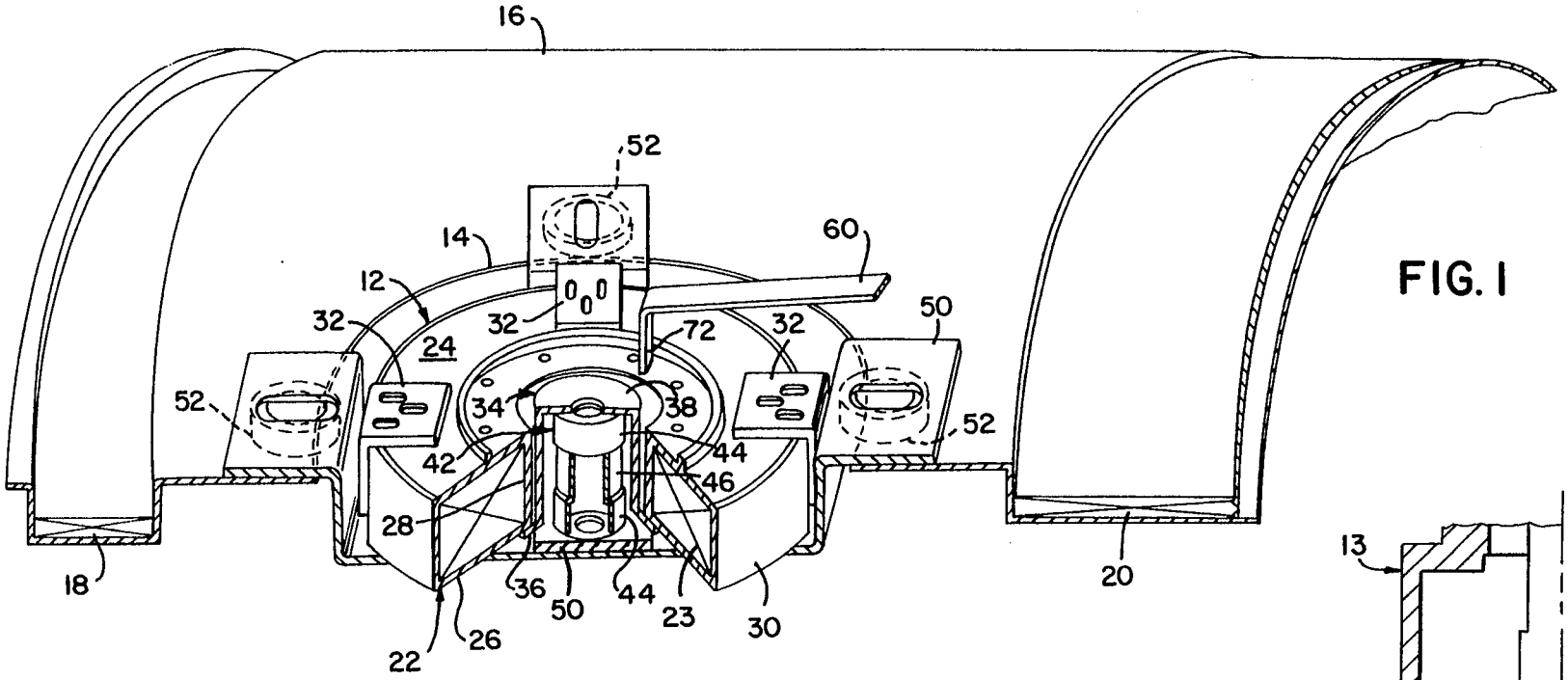
FIG. 1 is a perspective view of a thermal interface of the invention.

FIG. 1 illustrates a superconducting switch thermal interface of the invention for a cryogenless superconducting magnet. A switch 12 is nested within an opening 14 of magnetic coil support structure. 16. The support structure 16 is generally tubular with a horizontal longitudinal magnet axis (not shown) as viewed in FIGS. 1 and 2 and supports cylindrical magnetic coils 18 and 20. The support structure 16 is typically held within a vacuum space 17 defined between an outer shield 19 and an inner shield 21. The vacuum space 17 substantially reduces heat transfer by convection and the shields 19 and 21 substantially reduce heat transfer by radiation, as is well known in the art.

The support structure 16 may be of any suitable type. For example, a magnetic coil support structure as disclosed in commonly assigned U.S. Pat. Nos. 4,924,198, 4,935,714 and 5,302,869 may be applied to practice the present invention. In general, any magnetic support structure for a cryogenless superconducting magnetic may beneficially be applied to practice the present invention.

As is well known, the magnetic coils 18 and 20, which may for instance be a medium magnet coil and a large magnetc coil of a MR magnetic, must be cooled to below approximately 11° K. for them to enter the persistent state. To do this, the support structure 16 is thermally connected to the cold stage of a cryocooler 13. Cryocoolers are well known and are similar in operation to a home refrigerator, except that they generally are two stage with a first stage producing a cold sink at a temperature between 50° and 100° K. and a second stage producing a cold sink of about 10° K. To produce these cold temperatures, rather than compressing Freon gas like a home refrigerator, a cryocooler compresses high pressure helium and typically works on the Gifford-McMahon refrigeration cycle.

Any cryocooler having sufficient cooling capacity to produce a temperature below the transition temperature of the magnetic coils 18 and 20 may be employed in practicing the present invention. For example, one commercially available cryocooler which would be suitable is available from Leybold Vacuum Products Inc. of Export, Pa. under the commercial designation RGD580-GE cold head and RW4000/4200 compressor.

The switch 12 may be of any suitable construction. Such switches are well known and are typically bifilarly wound with superconducting wire and have an embedded heater (not shown) which may be selectively operated to warm the switch into a non-superconductive state. In the preferred embodiment shown in FIG. 1, the switch windings 23 are wound on a spool shaped bobbin 22 having an upper flange 24, a lower flange 26 and a cylindrical portion 28 spanning the flanges 24 and 26. The bobbin 22 is preferably made of a high thermal conductivity material such as OFHC (oxygen free high conductivity) copper so as to conduct heat from the switch 12 to the upper flange 24. An outer band 30, also of high thermal conductivity material such as OFHC copper, encloses the outer perimeter of the bobbin 22. Preferably, the switch 12 including the windings 21, the bobbin 22 and the outer band 30, is vacuum impregnated with epoxy for structural stability and to secure the various parts to one another. In addition, corner brackets 32 are preferably provided and screwed into the upper flange 24 and the outer band 30 for additional structural stability to hold the band 30 on the bobbin 22.

The corner brackets 32 should also be made of a highly heat conductive material such as OFHC copper so as to help conduct heat from the band 30 to the upper flange 24. The bobbin 22 is supported from an inverted cup shaped hanger 34. The hanger 34 has a flange 36 extending radially outwardly at its lower edge which is bolted to the lower flange 26 of the bobbin 22. The hanger 34 is preferably made of a material having a low thermal conductivity, such as ASTM standard G-10 fiber reinforced plastic.

The hanger 34 should also be made to have as small of a cross sectional area as possible, yet still provide the strength required to support the switch 12, to further reduce the thermal conductivity of the hanger 34. Closed end 38 of hanger 34 at the top of hanger 34 is secured by a bolt 40 (FIG. 2) to a tubular support 42. The tubular support 42 is preferably made of a material having a low thermal conductivity. G-10 fiber reinforced plastic may be used for the support 42, although preferably a material having an even lower thermal conductivity than G-10 is used. For example, the central tubular portion 46 may be made from a carbon fiber epoxy available from SCI Inc. of Pomona, Calif. under the commercial designation resin spec REZ-100 and SCI fiber 1M6-W-12K, and end caps 44 may be made from stainless steel. However, it should be noted that any material and any structure having a low thermal conductivity may be substituted for the support 42.

The support 42 should also have as low of a cross sectional area, as is needed to support the weight of the switch 12. The support 42 is shown made in three pieces, with end caps 44 and a central tubular portion 46, so as to enable assembling bolts 40 and 48 to the end caps 44. After assembling the bolts 40 and 48, the end caps 44 are secured by any suitable means, such as an adhesive or a threaded connection, to tubular potion 46.

The support 42 is supported at its lower end by two hanger straps 50 which span the opening 14 and are secured to the magnet coil support structure 16. The hanger straps 50 are also preferably made of a material having a low thermal conductivity, such as stainless steel. The hanger straps 50 cross one another and bolt 48 extends through the hanger straps where they cross one another and secures the lower end cap 44 of support 42.

Figure 3:
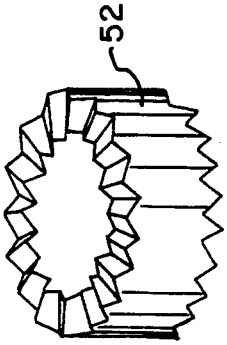
FIG. 3 is a perspective view illustrating a washer for the interface of FIGS. 1 and 2.

The ends of the hanger straps 50 are supported spaced above the support structure 16 by spacers 52 (see FIG. 3). Spacers 52 are preferably made of a material of a low thermal conductivity, such as G-10 fiber reinforced plastic, and have serrated ends to reduce the cross sectional area of the thermally conductive path between the support structure 16 and the straps 52. Bolts (not shown) extend through the ends of the straps 50, the spacers 52 and into the support structure 16 and may be threaded therein. Preferably the bolts are made of a material having a low thermal conductivity such as stainless steel or G-10 and a washer in the nature of the spacers 52 may be provided between the head of the bolt and the top of the straps 50.

Such a switch support structure, including the spacers 52, the hanger straps 50, the support 42 and the hanger 34 provides a very low thermal conductance path between the switch 12 and the support structure 16. In use, the temperature of the switch 12 will vary between approximately 10°-11° K. in the persistent state and 19°-20° K. in the normal, non-persistent state. The temperature of the structure 16 however will remain relatively constant at approximately 10° K. for it represents a large cold mass When the switch 12 is at approximately 20° K. and the support structure 16 is at approximately 10° K. the structure supporting the switch 12 on the struture 16 has a thermal resistance of approximately 1492° K./W which allows such a small heat transfer (0.007 W at a 10° K. temperature difference) that for practical purposes it may be neglected.

While it is desirable to thermally isolate the switch 12 from the support structure 16, it is necessary to cool the switch 12 to approximately the same temperature as the support structure 16, so that the switch 12 also enters the persistent state after ramping of the coils 18 and 20, to complete the superconductive circuit. To accomplish cooling of the switch 12, a switch cooling thermal bus bar 60 is provided.

The bus bar 60 connects the switch 12 to the cold stage 64 of cryocooler 13. Bolts 68 secure the end 70 of the bus bar 60 to cold stage 64 of cryocooler 13 and end 72 is soldered to upper flange 24 or otherwise suitably secured to the switch 12 so as to provide a thermally conductive path from the switch 12 to the bus bar 60. Thus, the bus bar 60 is in thermal communication with the switch 12 so as to collect and conduct heat from the switch 12 and dissipate it to cold stage 64. The bus bar 60 extends for a length L (the running length of the bus bar 60 from its end 72 which interfaces with the switch 12 to where the bus bar 60 makes thermal contact with the cold stage 64) from the cold stage 64 to the switch 12.

The thermal bus bar 60 is sized in length L and cross sectional area A so as to deliver a predetermined rate of cooling during ramping of the magnet and recovery of the switch 12 to the superconducting state. A long length L and small area A will result in a slow cooling rate, which is a benefit during ramping so as not to overtax the cooling capacity of the cold stage 64, but requires a relatively long period for the switch 12 to recover to the superconducting state after ramping. Although the bus bar 60 may be designed to provide any cooling rate, typical acceptable recovery periods for the superconducting switch are in the range of 30-60 minutes.

The thermal conductivity of the material of the bus bar 60 should have its highest value at about or below the operating temperature of the magnet, i.e., in the 10°-12° K. range. The thermal conductivity of the material should also be relatively high so as to allow making the bus bar of a relatively small cross-sectional area, and also should decrease with increasing temperature so as to maintain a fairly constant cooling rate during ramping. The reverse is also true during recovery, so that when the temperature of the switch 12 is decreasing as it approaches the temperature of the cold stage 64, the thermal conductivity of the cooling bus bar increases thus maintaining a relatively good cooling rate as ΔT is decreasing.

This can be seen in Fouriers heat conduction equation as follows:

$$Q=K(T)A(\Delta T/L)$$

where:

Q is the rate of heat transfer through the bus bar 60;

K(T) is the temperature dependent thermal conductivity of the material of the bus bar 60;

A is the cross-sectional area of the bus bar 60;

ΔT is the temperature gradient across the length L of the bus bar 60; and

L is the length L of the bus bar 60 as defined above.

During ramping, as the temperature of the switch increases and therefore the temperature gradient ΔT increases, the thermal conductance K(T) decreases, hence the heat load to the heat sink does not become excessive. The reverse is also true during recovery of the switch: as the temperature gradient ΔT decreases,- the thermal conductance K(T) increases so that the product of ΔT and K(T) maintains a good cooling rate as ΔT decreases.

One of the materials that has these characteristics is high purity OFHC copper. The proper sizing of the thermal bus bar 60 to deliver a fairly constant cooling load protects the cold stage 64 from thermal overload from the switch 12 during ramping. When the magnet has attained its operating current, the heating of the switch 12 is stopped by reducing the voltage across the switch 12 to zero. The switch is then cooled to the recovery temperature by thermal conductance through the thermal bus bar 60 connecting the switch 12 and the cold stage 64 of the cryocooler 13.

Figure 4:
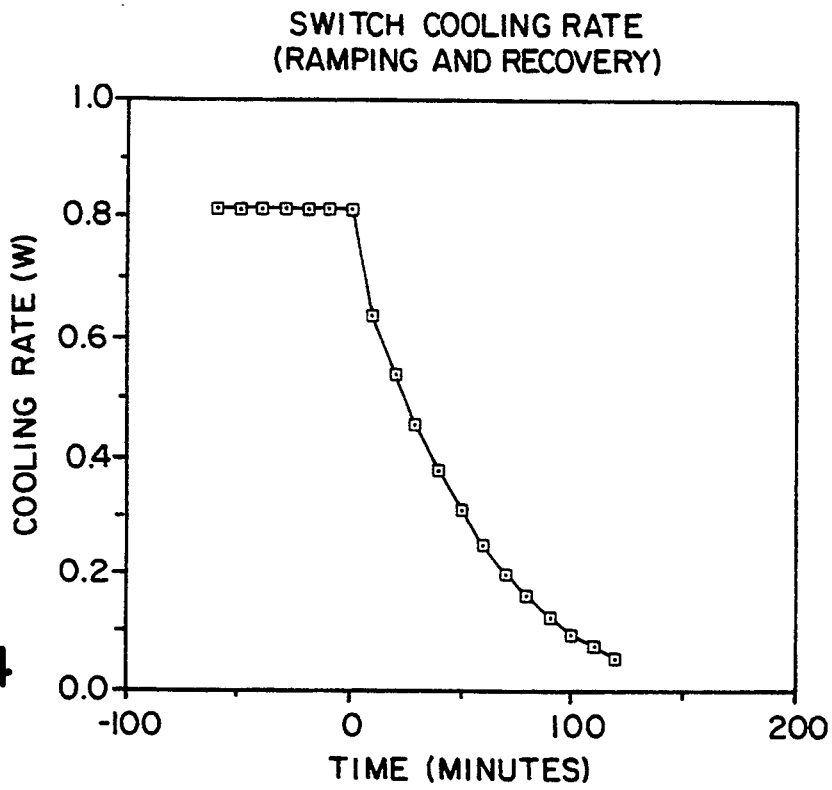
FIG. 4 is a graph illustrating a typical switch thermal performance for the thermal interface of FIGS. 1 and 2.

FIG. 4 illustrates a typical graph of the switch temperature versus time for a switch 12 constructed as described above. During ramping, the temperature of the switch is increased to 19.5° K. and after approximately 60 minutes, ramping stops and recovery begins. For the recovery period, the temperature of the switch decreases until it falls below 13.0° K. where the switch enters the persistent state. This occurs at time equals 72.0 minutes. The switch temperature may continue to fall somewhat after the switch enters the persistent state.

Figure 5:
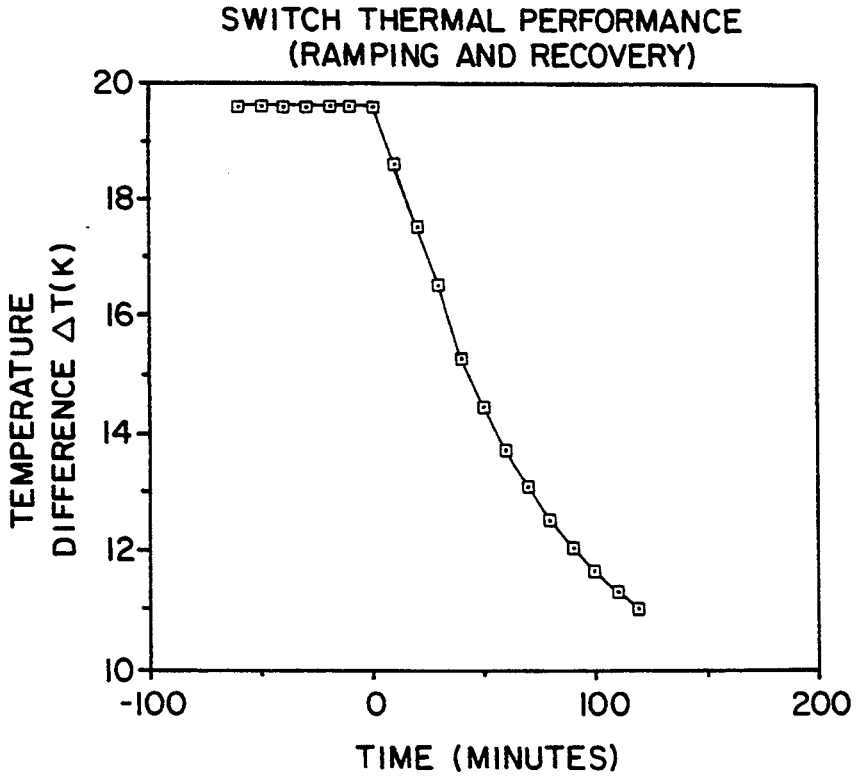
FIG. 5 is a graph corresponding in time to FIG. 4 and showing the cooling rate of the bus bar used in the thermal interface of FIGS. 1 and 2.

FIG. 5 is a graph showing the cooling rate of the thermal bus bar corresponding to FIG. 4. Time is given along the horizontal axis corresponding to the time given in FIG. 4. As can be seen, the cooling rate is maintained relatively constant at approximately 0.81 watts during ramping and decreases as ΔT decreases.

Figure 6:
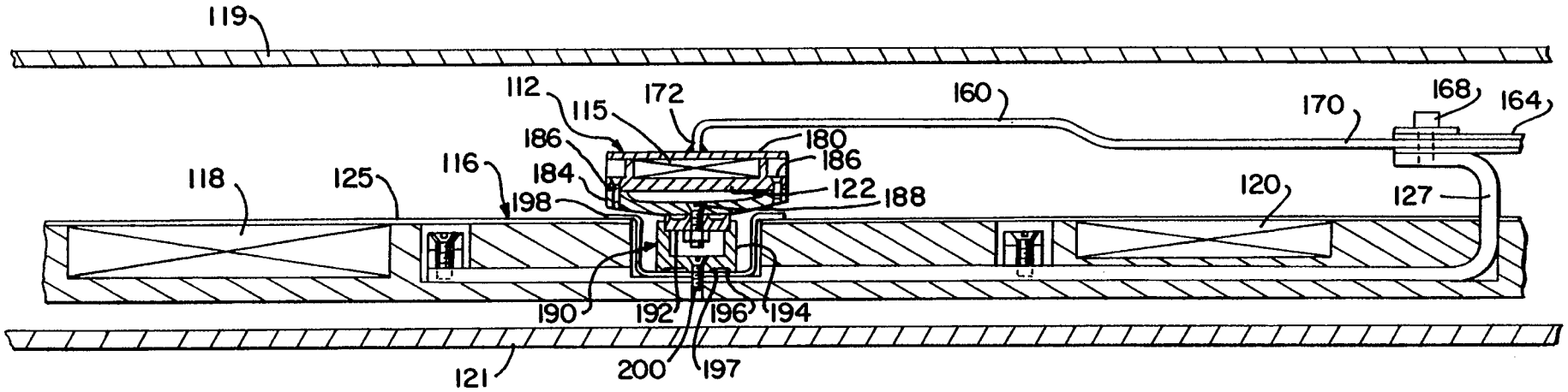
FIG. 6 is a sectional view of an alternate embodiment of a thermal interface of the invention.

FIG. 6 illustrates an alternate embodiment of a thermal interface of the invention. In FIG. 6, corresponding parts are identified with the same reference numbers as in the embodiment of FIGS. 1 and 2, plus 100.

The support structure 116 of the embodiment shown in FIG. 6 has coils 118 and 120 embedded in it and is clad with a copper sheath 125. A magnetic coil thermal bus bar 127 made of a highly heat conductive material such as OFHC copper is embedded in the support structure 116 and connected to the cold stage 164. The primary purpose of the main bus bar 127 is to conduct heat away from the support structure 116, so as to cool the coils 118 and 120 below the superconductive transition temperature so that the coils 118 and 120 are maintained in the persistent state.

Also attached to the cold stage 164 is a switch cooling bus bar 160 similar to the bus bar 60 of the first embodiment. The end 170 of the bus bar 160 is secured to the cold stage 164 so as to conduct heat from the bus bar 160 to the cold stage 164. From the cold stage 164, the bus bar 160 extends to the switch 112 and has an end 172 which is soldered or otherwise suitably secured to a sleeve cladding 180 of the switch 112. The cladding 180 encircles the outer periphery of the switch 112 and is made of a highly thermally conductive material such as OFHC copper so as to collect heat from the switch 112 and channel it to the bus bar 160.

Figure 2:
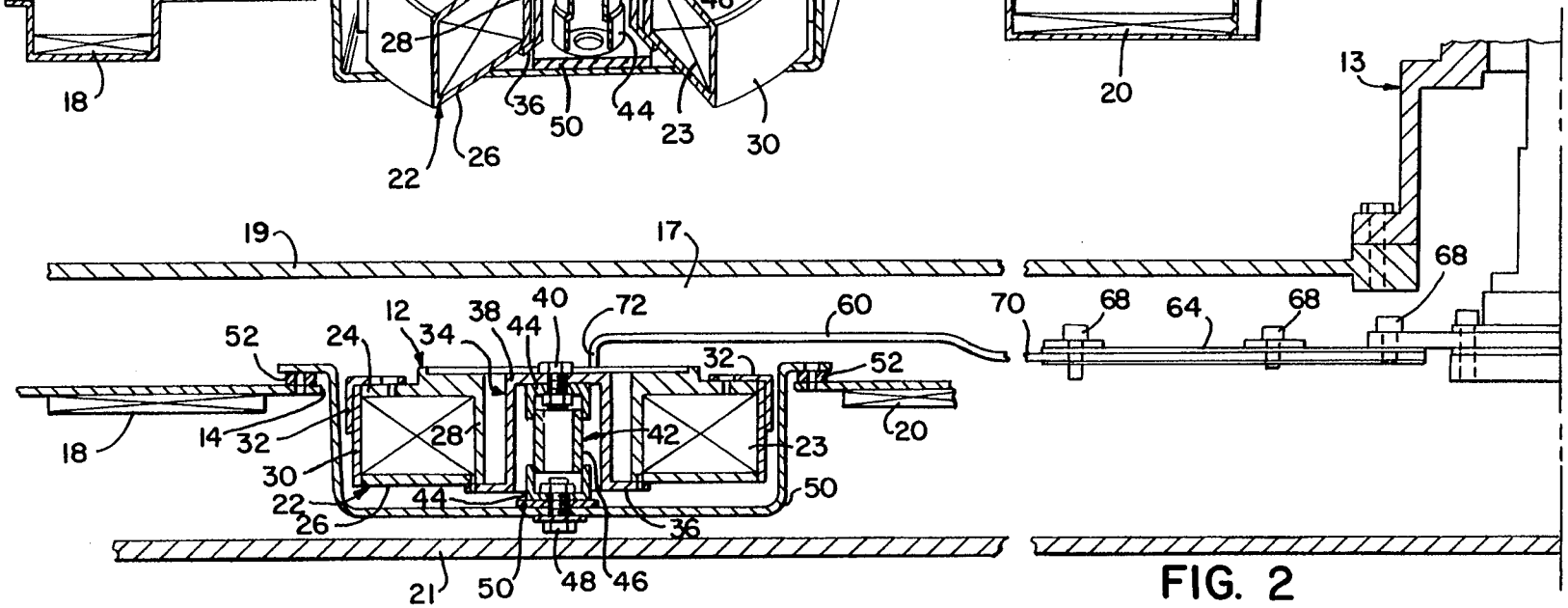
FIG. 2 is a sectional view illustrating the thermal interface of FIG. 1.

The switch coil 115 and the bobbin 122 shown in FIG. 6 differ from the coil 23 and bobbin 22 in that the coil 115 and bobbin 122 are coaxial with the coils 118 and 120, having a horizontal axis (not shown) as viewed in FIG. 6. In the construction of FIGS. 1 and 2, the switch 12 has an axis (vertical as viewed in FIGS. 1 and 2) which is substantially perpendicular to the axis of the coils 18 and 20. Therefore, the switch 112 encircles the support structure 116.

At spaced intervals around the periphery of the support structure 116, for example at four intervals spaced 90° apart, a thermal insulating support connects the switch 112 and the support structure 116. One of those supports is shown in FIG. 6. The support includes a strap-like yoke 184 which spans the longitudinal length of the switch 112 and may be for example about one inch wide (as measured along the dimension into the paper as viewed in FIG. 6). The yoke 184 is made of a material having a low thermal conductivity but high strength such as stainless steel. Screws 186 secure the switch 112 to the yoke 184. The central portion of the yoke 184 is secured by a screw 188 to a stand 190 made of a cap 192 and a base 194.

The stand 190 is preferably made of a material having a low thermal conductivity, such as G-10 fiberglass reinforced plastic. The cap 192 is secured to the base 194 by being threaded into it or by being adhesively secured to it, or by any other suitable means. The bottom of the base 194 is supported by an outer land 196 and an inner land 197 on a cup 198 which is received in a cup shaped recess in the support structure 116. The lands 196 and 197 provide a relatively small surface area for the flow of heat from the stand 190 to the cup 198. The cup 198 and stand 190 are secured to the support structure 116 by a screw 200. The cup 198 is preferably made of a material having a relatively high thermal conductivity such as OFHC copper. Since the bobbin 122 in this embodiment interfaces with the yoke 184 and is not needed to conduct heat away from the coil 115, the bobbin 122 is preferably made of a low thermal conductivity material such as G-10 fiberglass reinforced plastic.

As in the first embodiment, the switch cooling bus bar 160 is made of a material having a temperature dependent coefficient of thermal conductivity so that as the temperature of the bus bar changes during ramping and recovery, the heat flow through the bus bar remains relatively constant. For example, in a 0.5 Tesla magnet, the switch 112 may have a total heat capacity of 2675 J for a temperature change from 20° K. to 10° K. The bus bar 160 having a ratio of $L/A=17{,}000$ and made from OFHC copper having a residual resistivity ratio (RRR) of 60 provides cooling at an approximately constant rate of 0.87 watts. At this rate of cooling, the recovery time after ramping is approximately 220 minutes for the switch 112 to go from 20° K. to 10° K. at which temperature the switch 112 is in the persistent state.

Preferred embodiments of the invention have been described in detail above. Many modifications and variations to the preferred embodiments will be apparent to those of ordinary skill in the art. For example, materials may exist or be created that would actually result in the cooling rate through the bus bar decreasing with an increase in temperature between 10° K. and 20° K. Therefore, the invention should not be limited to the preferred embodiments described, but should be defined by the claims which follow.

We claim:

1. A superconducting magnet, comprising:

a superconducting magnet coil for producing a magnetic field along a magnet axis;

a structure supporting said coil to be substantially coaxial with said magnet axis;

a refrigerated cold sink for cooling said magnet coil below a transition temperature at which said coil becomes superconducting;

a superconducting switch for completing a closed superconducting electrical circuit including said coil;

means supporting said superconducting switch on said structure, said supporting means including means for thermally insulating said switch from said structure; and a thermal bus bar connecting said switch and said cold sink, said thermal bus bar providing thermally conductive communication directly between said cold sink and said switch;

wherein the thermal conductivity of the bus bar decreases as the temperature of the bus bar increases, thereby maintaining the rate of heat flow through the bus bar below a predetermined threshold during ramping of said coil and recovery of said switch to the persistent state according to Fourier's heat conduction equation.

2. A superconducting magnet as claimed in claim 1, wherein the thermal resistivity of the support means is at least an order of magnitude greater that the thermal resistivity of the bus bar.

3. A superconducting magnet as claimed in claim 1, wherein said switch has a longitudinal axis which is substantially coaxial with said magnet axis.

4. A superconducting magnet as claimed in claim 1, wherein said switch has a longitudinal axis which is substantially perpendicular to said magnet axis.

5. A superconducting magnet as claimed in claim 1, wherein said thermal insulation means includes a fiberglass reinforced support.

6. A superconducting magnet as claimed in claim 1, wherein said thermal insulation means includes a carbon fiber epoxy support.

7. A superconducting magnet as claimed in claim 1, wherein said thermal insulation means includes a support having serrated contact surfaces.

8. A superconducting magnet as claimed in claim 1, further comprising means for conducting heat from said switch to said bus bar.

* * * * *